United States Patent [19]

Scalfarotto

[11] Patent Number: 4,599,139

[45] Date of Patent: Jul. 8, 1986

[54] DEWATERING OF WET PAPER WEBS USING MANNICH ACRYLAMIDE POLYMERS

[75] Inventor: Robert E. Scalfarotto, Montvale, N.J.

[73] Assignee: American Cyanamid Company, Stamford, Conn.

[21] Appl. No.: 593,053

[22] Filed: Mar. 26, 1984

[51] Int. Cl.[4] ..... D21H 3/58
[52] U.S. Cl. ..... 162/168.3
[58] Field of Search ..... 162/168.3

[56] References Cited

FOREIGN PATENT DOCUMENTS 45-21241 7/1970 Japan ..... 162/168.3

*Primary Examiner*—Peter Chin
*Attorney, Agent, or Firm*—Frank M. Van Riet

[57] ABSTRACT

Dewatering of wet paper webs in general and particularly under high vacuum is improved by the addition of a Mannich acrylamide polymer having a molecular weight of not greater than about 300,000 to an aqueous slurry of papermaking fibers having a pH less than about 5.5.

7 Claims, No Drawings

DEWATERING OF WET PAPER WEBS USING MANNICH ACRYLAMIDE POLYMERS

BACKGROUND OF THE INVENTION

In the process of making paper wherein a fiber furnish is introduced at the inlet side of a conventional papermaking machine, such as a Fourdrinier machine, it has become the accepted procedure to add polymeric materials to the furnish in order to improve the drainage rate of the furnish on the machine. Generally, it was preferred to utilize high molecular weight materials for this purpose because the higher molecular weight materials have proven to be the more successful flocculants in other flocculation procedures. U.S. Pat. No. 3,323,979 is exemplary of the prior art in this area. This patent teaches the use of Mannich acrylamide polymers having molecular weights over 1,000,000 to increase the drainage rate of the furnish when preparing paper.

Papermaking machines of the Fourdrinier type generally contain three specific zones wherein water is removed from the deposited web of fibers supported on the wire. The first water removal zone is where water is removed by gravity. It is positioned immediately subsequent to the slice of the headbox. The next water-removal zone is the low vacuum drainage zone where a low vacuum is generated by the rapid motion of the wire of the Fourdrinier table over the foils and table rolls thus drawing water from the deposited wet web. The third and final dewatering zone between the first flat boxes and the couch roll is a high vacuum zone where the water is squeezed from within the fiber flocs by the negative vacuum pressure. The wet web at consistencies reading up to 25% leaves the Fourdrinier table wire at this point and is transferred to the press section of the paper machine. The web then moves to the driers or drying cylinders section where the remaining water is completely removed by evaporation. The energy required to operate the driers is the most expensive step in water removal from the wet web while dewatering on the wire of the Fourdrinier table is the least.

Attempts to reduce the amount of water present in the paper web introduced into the driers have been ongoing, and continue to be ongoing, since the costs of energy continue to rise. Therefore, if the removal of water from the wet paper web entering the driers in the papermaking process could be reduced, a long-felt need in the industry would be satisfied.

SUMMARY OF THE INVENTION

It has now been found that the amount of water in the wet paper web leaving the table wire at the couch roll of the Fourdrinier paper machine can be reduced by adding to the aqueous fiber furnish an effective amount of a Mannich acrylamide polymer having a molecular weight not greater than about 300,000 and maintaining the pH of the furnish at a value less than about 5.5, thereby resulting in the expenditure of less energy in the driers wherein the wet web is dried to a water content of about 5% or less. Alternatively, since the wet web is drier upon exitting the couch roll of the papermaking machine, the machine speed thereof can be increased, thereby resulting in an increase in the quantity of paper manufactured without further expenditure of drying energy.

DESCRIPTION OF THE INVENTION INCLUDING PREFERRED EMBODIMENTS

The novel process of the present invention comprises an improvement over the prior art process for the production of paper wherein an aqueous slurry of papermaking fibers containing an effective amount, generally from about 0.01 to about 0.3 percent solids, by weight, based on the fiber content of the furnish, preferably from about 0.05–0.15 percent, of a water-soluble, essentially linear, polymer having the formula:

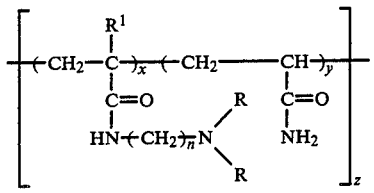

wherein R is an alkyl group of 1–2 carbon atoms, inclusive, $R^1$ is hydrogen or methyl, n is an integer of 1–6, inclusive, the ratio of x:y ranges from about 1:4 to about 4:1, respectively, preferably from about 1:3 to 3:1, respectively, and z is the degree of polymerization, is wet-laid in a papermaking machine to form paper sheet. The improvement of the present invention comprises the use of polymer having a molecular weight not greater than about 300,000 and the maintenance of the pH of the aqueous slurry of papermaking fibers at a value below about 5.5, preferably from about 4 to about 5. In a preferred embodiment, R is methyl, $R^1$ is hydrogen, and the ratio of x:y is about 3:1. The preferred molecular weight ranges from about 25,000 to about 150,000.

The above-mentioned patent describes the use of the same polymer as specified above with regard to its structure but having a molecular weight of at least about one million. The use of such a polymer as a drainage aid in the papermaking machine of the papermaking process results in the very effective removal of water at the gravity drainage and low vacuum zones of the papermaking machine, i.e. Fourdrinier machine, because the high molecular weight of the polymer causes the formation of large flocs of the fibers. Once the fibers are positioned on the wire, however, large spaces appear between the flocked fibers. These large spaces enable the rapid removal of water in the gravity and low vacuum drainage zones. Unfortunately, these large spaces are a detriment to the removal of water in the high vacuum dewatering zone of the apparatus because air is sucked through these spaces rather than impinging and pressing upon the flocked paper fibers. Therefore, water removal in the latter stage or zone of the apparatus is not as effective as one would desire.

The improvement represented by the instant invention, although not as effective in water removal at the gravity and low vacuum drainage zones, is more effective at the high vacuum zone of the apparatus to the extent that the overall water removal in the machine is more efficient.

The polymers useful in the practice of the process of the present invention may be prepared in accordance with the disclosure of the above-mentioned patent, hereby incorporated herein by reference. Salts of these polymers may also be used. The polymers may be added to the aqueous slurry of papermaking fibers, as is known, at any point prior to formation of the web, usually after the beating and refining operations.

Alum in amounts of 0.1–2.0% of the slurry may also be added and is, in fact, oftimes preferred.

The fibers used to form the papermaking slurry may comprise any known papermaking fibers such as bleached softwood, bleached hardwood, unbleached kraft, mixtures thereof and the like.

Comonomers such as acrylic acid, methacrylic acid, 2-aminoethyl acrylate, methyl acrylate, acrylonitrile, styrene, vinyl acetate and the like may also be incorporated into the chain of the polymers useful herein and still be within the scope of the present invention. These comonomers may be present in amounts ranging from about 5–25%, by weight, of the total polymer.

The following examples are set forth for purposes of illustration only and are not to be construed as limitations on the present invention except as set forth in the appended claims. All parts and percentages are by weight unless expressed otherwise.

The Simulated Couch Consistency or Percent Dry/Wet Ratio values expressed in the following examples were ascertained using a PRM Vacuum Water Release Analyzer developed and distributed by Paper Research Materials Co., 770 James St., Apt. 1206, Syracuse, N.Y.

EXAMPLE 1

To a furnish composition comprising about 1.0% of a 50/50 mixture of bleached softwood/hardwood papermaking fibers, 0.25% of alum, and 10% of amorphous silica filler and having a pH of 4.7–4.8, are added, as 0.05 solids, a series of polymers containing 75% dimethylaminomethylacrylamide radicals and 25% acrylamide radical of varying molecular weights. The resultant slurry is dewatered on the Vacuum Water Release Analyzer to obtain the Similated Couch Consistency or Percent Dry/Wet Ratio (S.C.C.) after low vacuum drainage and high vacuum dewatering. The value expressed is an average of 10 tests. The results are set forth in Table I below.

TABLE I

| Run | Polymer M.W. | S.C.C. |
|---|---|---|
| a | 400,000 | 21.693 |
| b | 298,000 | 21.857 |
| c | 133,000 | 21.979 |
| d | 44,000 | 22.006 |

EXAMPLE 2

The procedure of Example 1 is again followed except that the pH of the slurry is 5.5. The results are set forth in Table II, below.

TABLE II

| Run | Polymer M.W. | S.C.C. |
|---|---|---|
| a | 500,000 | 25.012 |
| b | 298,000 | 25.463 |
| c | 133,000 | 25.385 |
| d | 44,000 | 25.334 |

EXAMPLE 3

The procedure of Example 1 is again followed except that the concentration of alum is increased to 0.5% and the amorphous silica is eliminated. The pH is 4.5. The results are set forth in Table III, below.

TABLE III

| Run | Polymer M.W. | S.C.C. |
|---|---|---|
| a | 400,000 | 24.256 |
| b | 298,000 | 24.474 |
| c | 133,000 | 24.387 |
| d | 44,000 | 24.730 |

EXAMPLE (Comparative)

The procedure of Example 1 is again followed except that the pH is increased to 6.4. The results are set forth in Table IV, below.

TABLE IV

| Run | Polymer M.W. | S.C.C. |
|---|---|---|
| a | 500,000 | 22.227 |
| b | 298,000 | 21.975 |
| c | 133,000 | 21.760 |
| d | 44,000 | 21.701 |

EXAMPLE 5 (Comparative)

Again following the procedure of Example 1 except that the filler comprises 15% of calcium carbonate and the pH is 7.2–7.5, the results set forth in Table V, below, are recorded.

TABLE V

| Run | Polymer M.W. | S.C.C. |
|---|---|---|
| a | 500,000 | 21.839 |
| b | 298,000 | 21.683 |
| c | 133,000 | 21.546 |
| d | 44,000 | 21.371 |

EXAMPLE 6 (Comparative)

When following the procedure of Example 1 except that the pH is 7.6, the results set forth in Table VI, below, are recorded.

TABLE VI

| Run | Polymer M.W. | S.C.C. |
|---|---|---|
| a | 500,000 | 25.033 |
| b | 298,000 | 24.696 |
| c | 133,000 | 24.509 |
| d | 44,000 | 23.071 |

EXAMPLE 7 (Comparative)

The procedure of Example 1 is again followed except that the pH is 7.8 and higher molecular weight polymer is employed. Table VII, below, set forth the results recorded.

TABLE VII

| Run | Polymer M.W. | S.C.C. |
|---|---|---|
| a | 4,000,000 | 19.869 |
| b | 2,500,000 | 21.326 |
| c | 500,000 | 21.068 |
| d | 298,000 | 20.808 |

EXAMPLE 8

The procedure of Example 1 is again followed except that the fibers in the slurry comprise a mixture (90/10) of unbleached kraft and recycled waste paper fibers. The alum concentration is 0.9%, the filler is omitted, 0.15% of rosin size is added and the pH is 4.5. The results are set forth in Table VIII, below.

TABLE VIII

| Run | Polymer M.W. | S.C.C. |
|---|---|---|
| a | — | 12.567 |
| b | 500,000 | 13.242 |
| c | 44,000 | 13.282 |

EXAMPLE 9 (Comparative)

The procedure of Example 7 is again followed except that the pH is 6.0. Results are recorded in Table IX, below.

TABLE IX

| Run | Polymer M.W. | S.C.C. |
|---|---|---|
| a | — | 13.601 |
| b | 500,000 | 14.242 |
| c | 44,000 | 13.926 |

EXAMPLE 10

Again following the procedure of Example 8 except that the fibers are 100% unbleached kraft, the alum concentration is reduced to 0.5% and the rosin size is replaced by 6% black liquor solids, the results set forth in Table X are observed.

TABLE X

| Run | Polymer M.W. | S.C.C. |
|---|---|---|
| a | — | 10.896 |
| b | 500,000 | 11.412 |
| c (Batch 1) | 44,000 | 11.732 |
| d (Batch 2) | 44,000 | 11.699 |

EXAMPLE 11 (Comparative)

When the procedure of Example X is again followed except that the pH is 6.0, the results set forth in Table XI are obtained.

TABLE XI

| Run | Polymer M.W. | S.C.C. |
|---|---|---|
| a | — | 11.299 |
| b | 500,000 | 12.169 |
| c | 44,000 | 12.088 |

EXAMPLE 12

A slurry containing 100% unbleached kraft fibers, 0.5% alum, 1.0% amorphous silica, and 6.0% black liquor solids at a pH of 4.5 is treated and tested as in Example 1. The results are set forth in Table XII, below.

TABLE XII

| Run | Polymer M.W. | S.C.C. |
|---|---|---|
| a | 500,000 | 12.383 |
| b | 44,000 | 13.746 |
| c | 25,000 | 13.837 |
| d | 10,000 | 13.960 |

EXAMPLE 13

The procedure of Example 1 is again followed except that the pH is 4.3–4.5. Testing results are set forth in Table XIII, below.

TABLE XII

| Run | Polymer M.W. | S.C.C. |
|---|---|---|
| a | — | 12.169 |
| b | 500,000 | 22.410 |
| c | 44,000 | 22.402 |
| d | 25,000 | 22.138 |
| e | 10,000 | 21.976 |

EXAMPLE 14

When the procedure of Example 1 is again followed except that the dimethylaminomethyl acrylamide radicals of the polymers are replaced by dimethyl-(aminohexyl acrylamide) radicals, similar results are achieved.

EXAMPLE 15

The procedure of Example 1 is again followed except that the dimethylaminomethylacrylamide radicals are replaced by diethylaminomethyl acrylamide radicals. Again, excellent results are achieved.

EXAMPLE 16

When a polymer having only 3% of the dimethylaminomethyl acrylamide radicals is employed in the procedure of Example 1, similar results are achieved.

I claim:

1. In a method for the production of paper wherein an aqueous slurry of paper-producing fibers containing from about 0.01 to about 0.3 percent solids, by weight, based on the fiber content of the furnish, of a water-soluble, essentially linear, polymer having the formula:

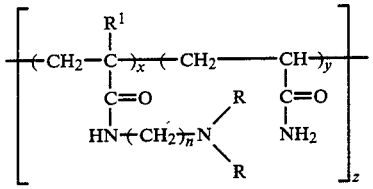

wherein R is an alkyl group of 1–2 carbon atoms, inclusive, $R^1$ is hydrogen or methyl, n is an integer of 1–6, inclusive, the ratio of x:y range from about 1:3 to about 3:1, respectively, and z is the degree of polymerization, is wet laid to form paper, the improvement wherein z is such that the molecular weight of the polymer is not greater than 300,000 and the pH of the slurry is less than about 5.5.

2. A method according to claim 1 wherein both R radicals are methyl.

3. A method according to claim 1 wherein n is 1.

4. A method according to claim 1 wherein n is 1 and both R radicals are methyl.

5. A method according to claim 1 wherein n is 1, both R radicals are methyl and R′ is hydrogen.

6. A method according to claim 1 wherein n is 1, both R radicals are methyl, R′ is hydrogen and the ratio of x:y is about 3:1.

7. A method according to claim 1 wherein the pH is from about 4–5.

* * * * *